United States Patent [19]

Lau

[11] Patent Number: 4,534,087

[45] Date of Patent: Aug. 13, 1985

[54] ADJUSTABLE BUCKLE

[76] Inventor: Wah Lau, 41-31 149th Pl., Flushing, N.Y. 11355

[21] Appl. No.: 557,059

[22] Filed: Dec. 1, 1983

[51] Int. Cl.[3] ..... A44B 11/00

[52] U.S. Cl. ..... 24/163 K; 24/171; 24/180; 24/303; 2/235; 2/236

[58] Field of Search ..... 24/163 K, 163 R, 171, 24/184, 185, 187, 573, 303, 688; 2/235, 236

[56] References Cited

U.S. PATENT DOCUMENTS

| | | | |
|---|---|---|---|
| 824,745 | 7/1906 | Salisbury | 2/236 |
| 849,677 | 4/1907 | Grote | 2/236 |
| 878,996 | 2/1908 | Pasley | 24/180 |
| 1,134,016 | 3/1915 | Sanders | 24/163 K |
| 2,290,573 | 7/1942 | Rasp | 24/171 |
| 2,475,226 | 7/1949 | Ellis | 24/303 |
| 3,063,118 | 11/1962 | Salter et al. | 24/303 |
| 4,429,439 | 2/1984 | Waugh | 2/235 |

*Primary Examiner*—Victor N. Sakran

*Attorney, Agent, or Firm*—Lackenbach Siegel Marzullo Presta & Aronson

[57] ABSTRACT

An adjustable buckle having elements for fixing to respective opposed flaps of a garment with a cover formed to engage one element and in pulling the respective flap of the one element over the respective flap of the second element to engage the second element in a plurality of positions so that the flaps are secured and the garment buckled in a plurality of positions. The buckle is particularly suited for closing pants, and eliminating the top button closure on the pants over the fly. The buckle eliminates the need for belts and provides a flat, contoured appearance to the pants.

20 Claims, 14 Drawing Figures

ADJUSTABLE BUCKLE

FIELD OF THE INVENTION

This invention relates to adjustable buckles. Specifically this garment relates to an adjustable buckle for closing a garment or like object in a plurality of positions.

BACKGROUND AND DISCUSSION OF THE PRIOR ART

Heretofore, buttons, snaps or like closures were used to close the flaps of a garment such as pants or jeans above the fly portions. This conventional design required the presence of a belt to achieve a "finished" or esthetically acceptable appearance.

With modern casual wear such pants or jeans are often worn without belts, and in closing the pants, the zipper of the fly is twisted and an esthetically undesirable bulge appears between the zippered portion and the button above the zipper.

Furthermore, without a belt there is no adjustable fitting of the garment to the girth of the wearer.

Now there is provided by the present invention an adjustable buckle which closes a garment to a plurality of fitting positions, eliminating the need for a belt and yet providing a smooth, adjusted, contoured fit to the wearer.

It is therefore a principal object of the present invention to provide a novel adjustable buckle.

It is a further object of the present invention to provide a buckle as aforesaid for multiple positioned closure of a garment.

DESCRIPTION OF THE PREFERRED EMBODIMENTS

Figure 1:
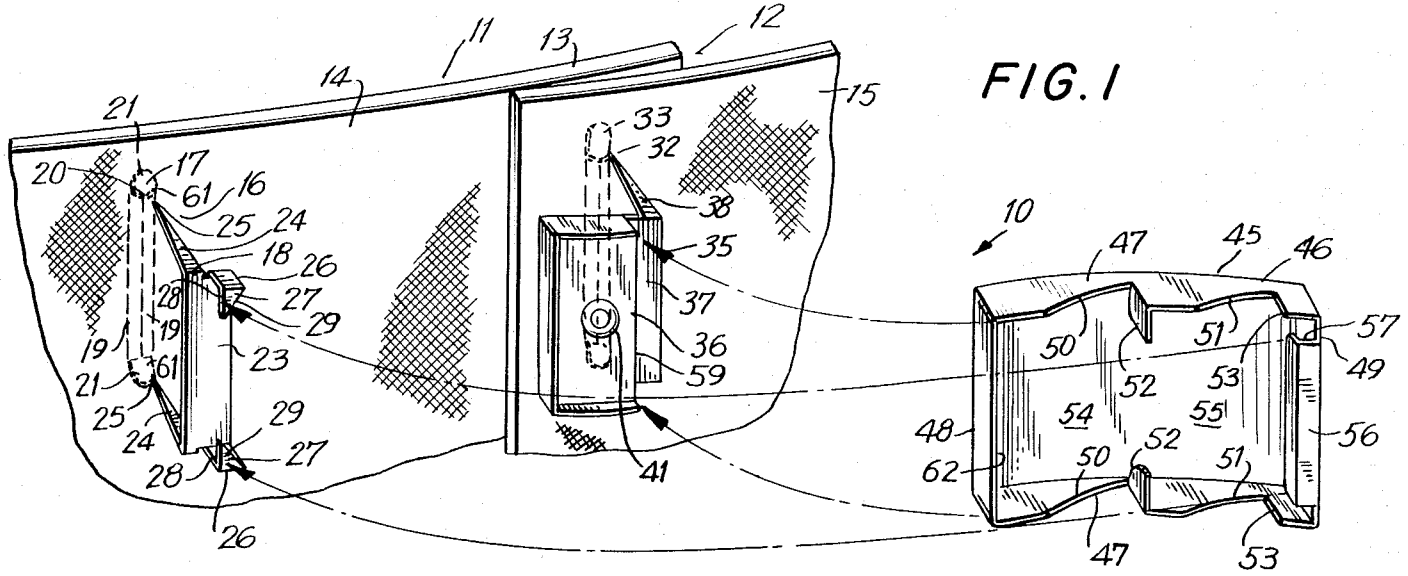
FIG. 1 is a perspective exploded view of a first embodiment of the buckle of the present invention assembled to the pants of the wearer.
Figure 2:
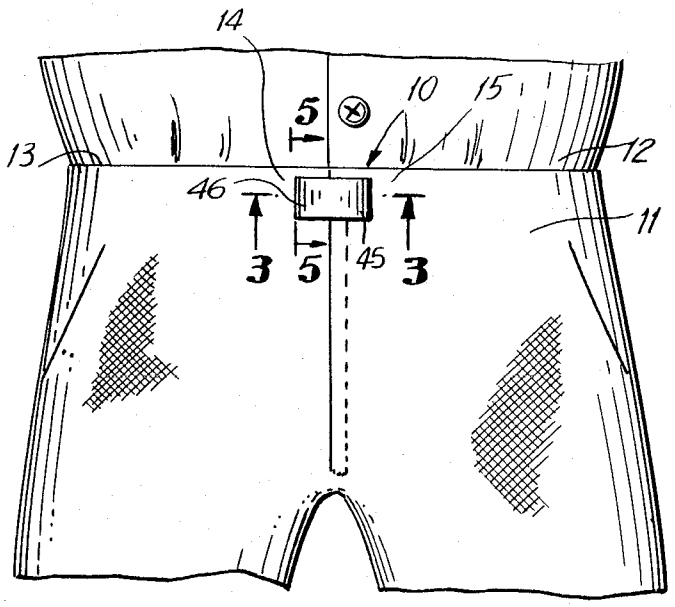
FIG. 2 is a front elevational view of the buckle of FIG. 1 in a closed pants position.

Referring to FIGS. 1–6, there is shown one embodiment of the present invention, namely, buckle 10.

A pair of pants or trousers 11 is shown having a waist portion 12 having top free edge 13 and overlapping flaps 14 and 15. Metal attachment element 16 is generally formed of a back plate 17 and fastener element 18. Plate 17 is formed with infolded portions 19 forming channel 20 and having oppositely disposed impact plate portions 21. Plate 17 is disposed so that infolded portions 19 are facingly disposed to the inside 22 of flap 14. Fastener element 18 is formed of a flat center member 23 having oppositely disposed downwardly depending tapered flanges 24 with sharp pointed edges 25. A pair of upwardly disposed angled flanges 26 are provided with topmost portions 27 having angled edges 28 and 29, for purposes hereinafter appearing.

Figure 3:
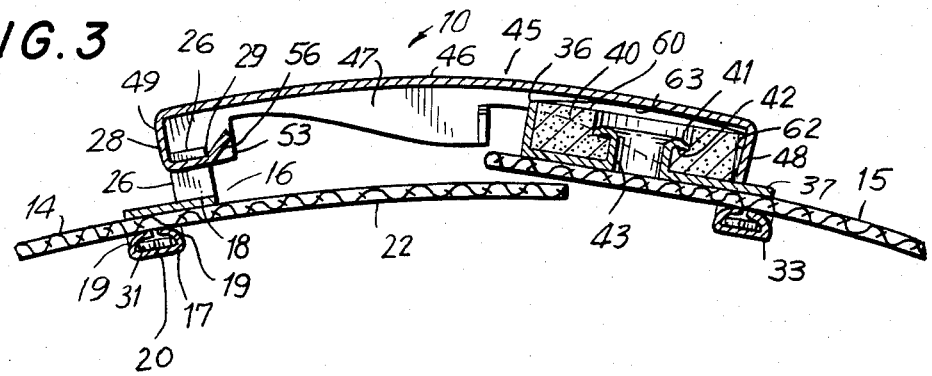
FIG. 3 is an enlarged sectional view taken along ling 3—3 of FIG. 2.
Figure 4:
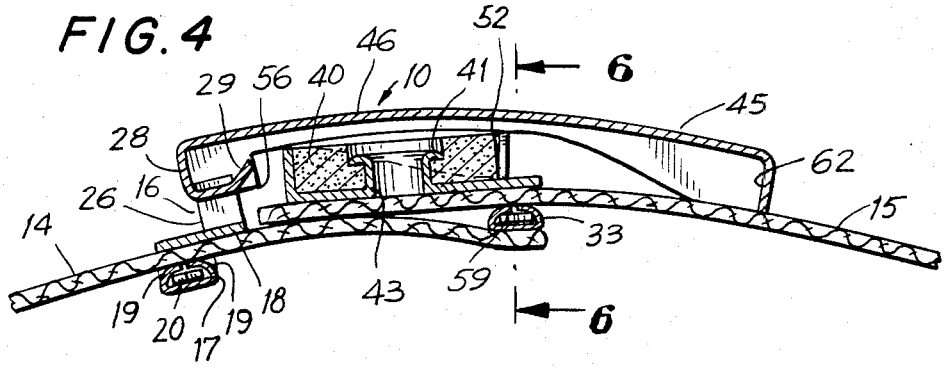
FIG. 4 is a view of the buckle as in FIG. 3 but in an adjusted second position.
Figure 5:
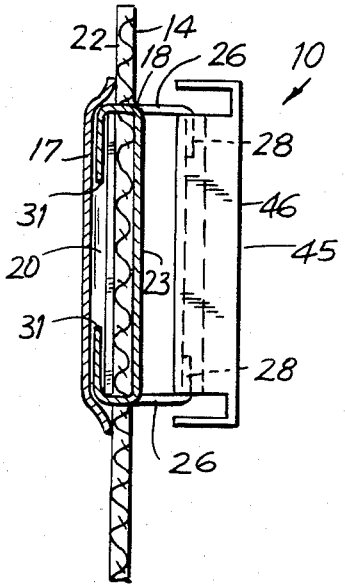
FIG. 5 is an enlarged sectional view taken along line 5—5 of FIG. 2.
Figure 6:
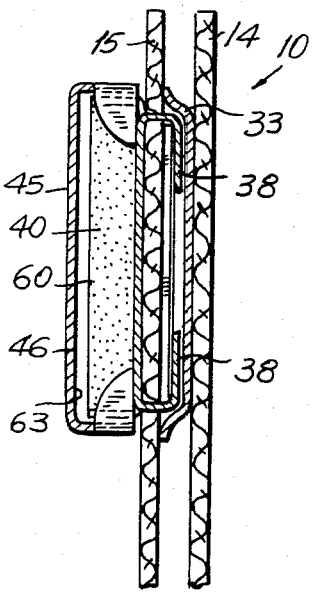
FIG. 6 is a sectional view taken along line 6—6 of FIG. 4.
Figure 7:
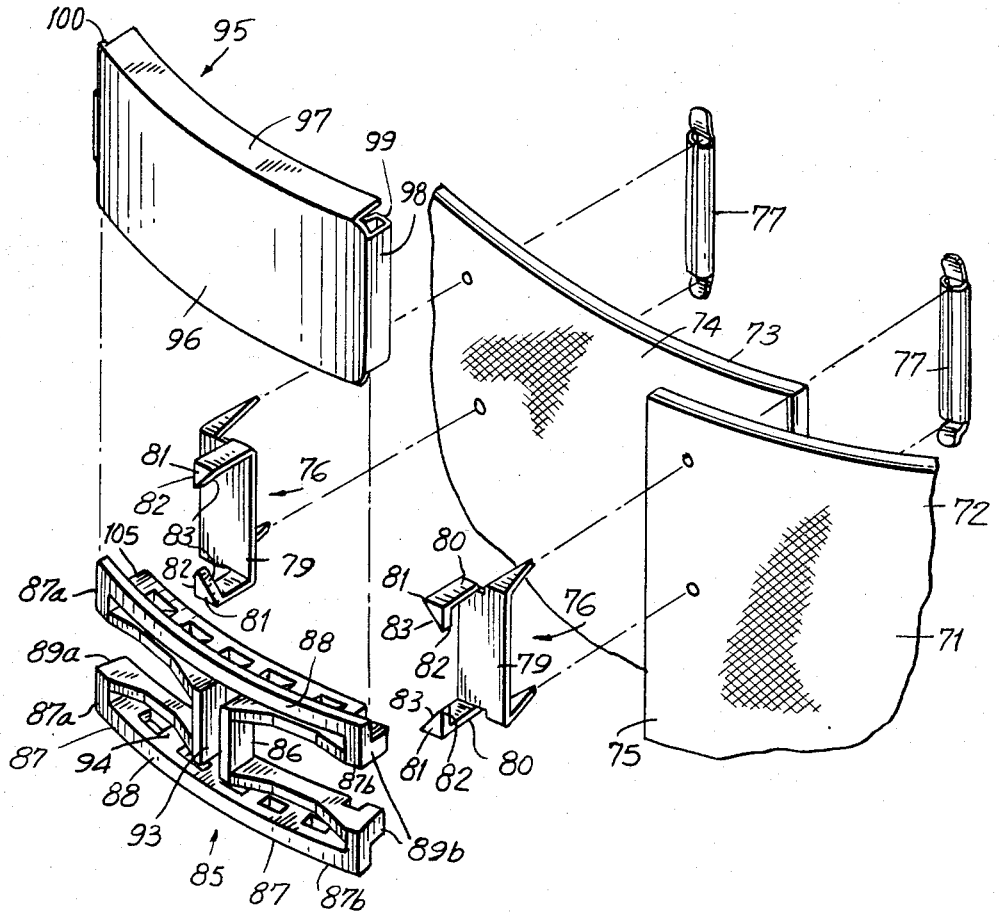
FIG. 7 is a perspective exploded view of a second embodiment of the buckle of the present invention assembled to the pants of the wearer.
Figure 8:
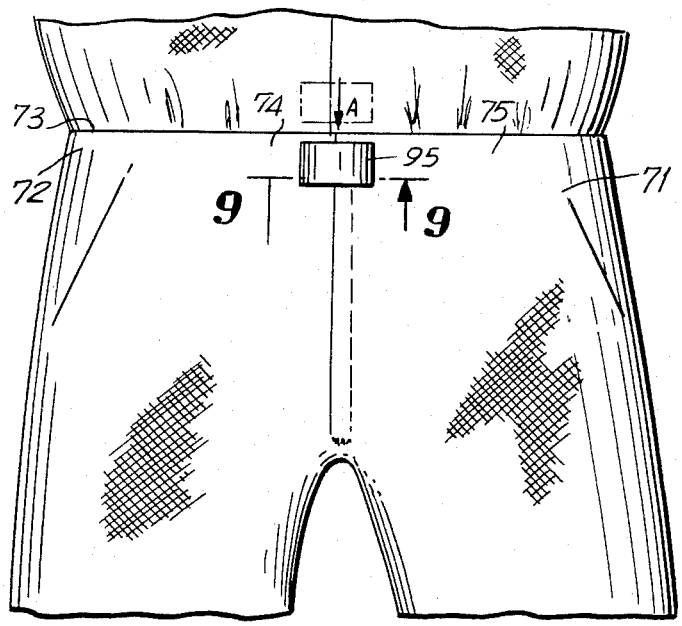
FIG. 8 is a front elevational view of the buckle of FIG. 7 in a pants closed position.
Figure 11:
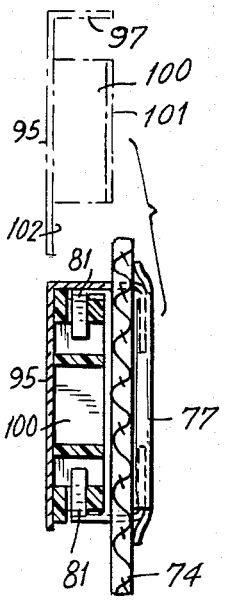
FIG. 11 is a sectional view taken along line 11—11 of FIG. 10 with a partially assembly of the metal overcap in broken line view.
Figure 9:
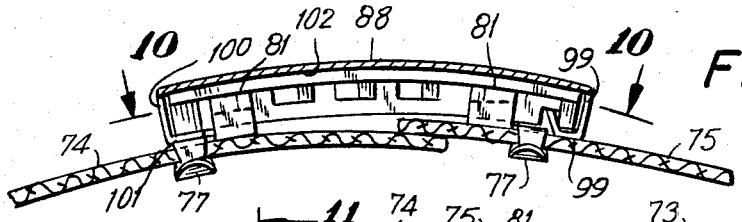
FIG. 9 is an enlarged sectional view taken along line 9—9 of FIG. 8.

Attachment element 16 is assembled to flap 14 by driving pointed edges 25 through the flap as at 29 to abut portions 21 so as to cause pointed flanges 24 to bend to a 90° corner as at 30 (FIG. 5) and reside in channel 20 as at 31 (FIGS. 3 and 4).

Metal attachment element 32 is formed of back plate 33, similar in construction to plate 17, and fastener assembly 35. Assembly 35 is formed of rectilinear housing 36 with central portion 37 and depending pointed edged flanges 38. Flanges 38 are similar in design and construction to tapered, pointed flanges 24, so that assembly 35 is mounted to flap 15 with plate 33 is a similar mounting to the mounting of element 18 to flap 4 through plate 17. A permanent magnet 40 is sized to fit into housing 36 and is held in place by grommet 41 attached to crimped portion 42 of tubular housing portion 43 or other suitable bolt means.

A ferro-metal cover 45 is formed with a top wall 46, sides 47, end wall 48, and end wall 49. Sides 47 are formed with curved edges 50 and 51 and infolded tabs 52 and edges 53 so as to form recesses or cavities 54 and 55, for purposes hereinafter appearing. End wall 49 is formed with a bent lip 56 forming channel 57. Cover 45 is assembled by lip 56 engaging edges 28 so as to hold the cover to element 16. With cover 45 engaging element 16, the wearer pulls trouser flap 15 over trouser flap 14. Wall 59 of housing 36 abuts the inside 62 of wall 48 and magnet face 60 is facingly disposed to ferro-metallic surface 65 of cover top wall 46 (FIG. 3). In this manner the trouser flaps are held in a first closed position.

To adjust the buckle 10 to a second closed position, cover 10 is lifted from surface 60 and the cover and element 17 and trouser flap 15 pulled closer to flap 14 so that housing 36 with magnet 40 is removed from recess 54 with housing wall 59 now abutting tabs 52, with the magnet face 60 opposed to surface 63 of cover top wall 46, so that the cover is magnetically held in the adjusted closed position (FIG. 4).

Referring to FIGS. 7–14, there is shown a second embodiment of the invention, namely buckle 70.

A pair of pants or trousers 71 is shown having waist portion 72 with top free edge 73 and overlapping flaps 74 and 75. Metal attachment elements 76, are in broad terms, constructed of back plates 77 and fastener elements 78. Plates 77 and fastener element 78 are similar in design and construction to plate 17 and fastener element 18 of the embodiment of FIG. 1–6. It is to be noted however that in the latter embodiment there appeared identical pairs of plates 77 and 78 on respective opposed flaps 78 and 75. And when assembled to the flaps the pants in front view have the appearance of central portions 79 with outwardly disposed arms 80 with outermost flanges or prongs 81 formed with angled surfaces 82 and 83, for purposes hereinafter appearing.

A plastic insert 85 is molded or formed of generally H-shaped configuration with a central hub or cross-post 86 and opposed legs 87, forms leg ends 87*a* and 87*b*. Each leg 87 is formed with an arcuately curved top wall 88 and depending rear wall 89. Side walls 90 depend downwardly from top wall 88. Each side wall 90 is formed with a plurality of similarly located, sized and shaped tapered recesses or grooves 91*a*–91*d* and tapered recess or groove 92. It is also noted that side walls 90 and the grooves 91*a*–91*d* and 92 lie in an arcuate curve that parallels the contour of top wall 88. Side wall 90 is formed with tapered end walls 105 and 106, for purposes hereinafter appearing.

Metal cover 95 is formed with arcuate top wall 96, one side wall 97, end wall 98 with bent lip 99, and end wall portion 100 with lip 101. Cover 95 is arcuately contoured to follow the waistline. Cover 95 may be pre-assembled to insert 85 before pants closure by sliding the cover over the insert 85 so that insert end wall portions 89*a* are lodged within lip 101 and insert end wall portions 89*b* is lodged within bent lip 99 with insert arcuately contoured top wall 88 slidingly engaging the inside 102 of cover top wall 96 until stopped by side wall 97. The metal cover 95 plastic insert 85 assembly is now ready for assembly to the attachment fastener elements 78 for adjustable closure of the pants. Alternatively insert 85 may be assembled to fastener elements 78 and the pants adjustably closed, with metal cover 95 then assembled to the insert as shown by arrow A in FIG. 8.

Figure 13:
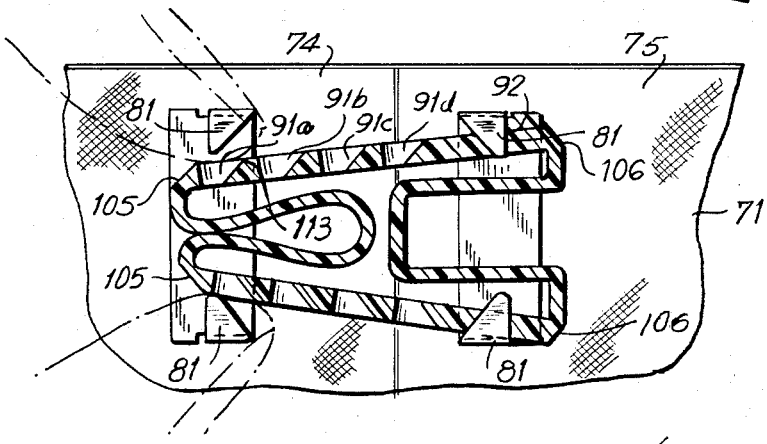
FIG. 13 is a view of the buckle as in FIG. 10, but showing the flexing of the plastic insert for adjusted positioning of the buckle.
Figure 14:
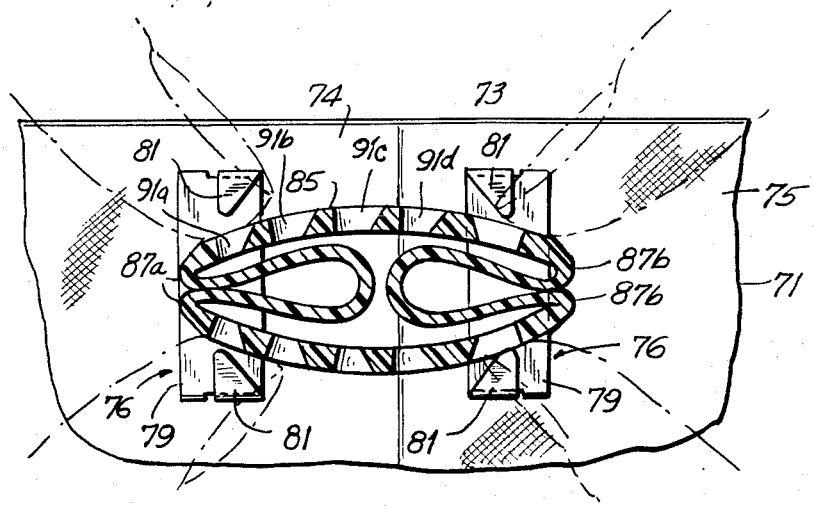
FIG. 14 is a view of the buckle as in FIG. 3 but showing flexing of the insert for removal of the insert from the pants fixed mounting elements on the pants.

It is also important to note than insert 85, and particularly post 86 and legs 87 are formed of recessed portions 98 and 94 respectively. In this manner of construction the insert is lightweight and ends 87*a* and 87*b* are flexible as best shown in FIGS. 13 and 14. Of course the flexibility of the insert would also depend upon the choice of plastic, and a broad range of moldable plastics are contemplated, with polyacrylonitriles being preferred. FIGS. 13 and 14 represent the use of a highly flexible plastic.

Figure 10:
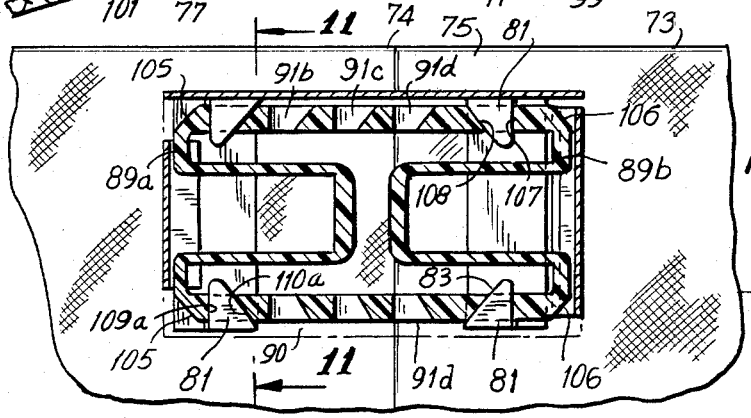
FIG. 10 is a sectional view taken along line 10—10 of FIG. 9.
Figure 12:
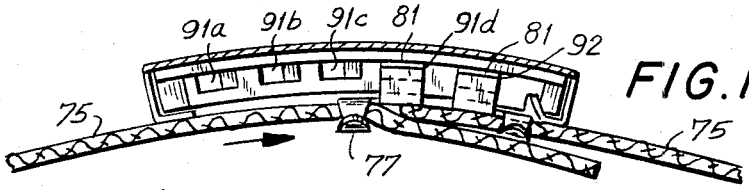
FIG. 12 is a sectional view of the buckle as in FIG. 9 but in another adjusted position.

Insert 85 may be assembled to elements 78 by first squeezing leg ends 87*b* so flanges or prongs 81 can be inserted into recesses 92 so that element wall 82 abuts insert surface 107 and element angled wall 83 abuts tapered surface 108 of recess 92 (FIG. 10). With end 87*b* attached, the insert 85 can be pulled across so that flap 75 overlies flap 74 and element 78 on flap 74 inserted into recess 91*a* so that element wall 82 abuts surface 109*a* and element angled wall 83 abuts surface 110*a*. (FIG. 10). Alternatively, insert 85 may be pulled directly across, without the finger pressing action of FIG. 13, until element angled wall 83 on flap 74 abuts bevelled wall 105 causes self-flexing of legs 87*a* so that the angled wall continues to ride along wall 105 until flange 81 snaps into recess 91*a*. At this point, the buckle closes the pants in the first adjusted position, namely 91*a*. To further tighten the pants, the insert and flap is pulled further in the tightening direction so that angled flange wall 83 slides along surface 110*a* so as to ride out of recess 91*a* and pressingly slidingly engage side wall portion 113 and then snap into recess 91*b*, that is into the second adjusted tightened position. It is of course understood that this buckle adjustment or pants tightening can be accomplished with the metal cover assembled to the insert. By merely pulling the cover, the insert will follow, causing the fastener element flange to snap into and ride out of the successive positions or recesses. The fully tightened position 91*d* is shown in FIG. 12. Positions 91*a*–91*d* are 2–3 cms. apart.

To loosen the pants, the insert may be squeezed as best shown in FIG. 13 and flap 75 pulled away from flap 74 until the desired position is formed.

To remove the metal cover and plastic insert assembly, cover 95 is slidably removed from the insert and the insert squeezed at both ends 87*a* and 87*b* to release the flanges or prongs 80. It is desirable to remove the cover 95 and insert 85 for cleaning or laundering the pants.

There has thus been shown and described certain buckles of the present invention which provide for adjustable closure of the pants while eliminating the need for belts and fly top button closure, thereby avoiding the undesirable aesthetic aspects of the belts and fly top button closure, while providing a clean, contoured, aesthetically more desired and comfortable closure of pants, trousers, skirts or other garments and constructions.

It is of course understood that various modifications may be made that are within the contemplation of the invention without departing from the scope of the invention as defined in the appended claims.

What is claimed is:

1. An adjustable buckle comprising a first member comprising means to attach said member to the front face of a first material flap, and having engagement means disposed on said front face oppositely disposed from said attachment means, and a second member comprising means to attach said second member to the front face of a second material flap and having engagement means disposed on said second front face and oppositely disposed from said second attachment means, and a cover being formed with tab means to removably engage the first member engagement means and means to removably engage the second member engagement means in two positions so that the cover bridges the flaps to secure the flaps in an overlying manner in the two positions.

2. The adjustable buckle of claim 1, further comprising a garment having said flaps and said flaps being formed at the edge of the garment.

3. The adjustable buckle of claim 2, said garment being pants and said edge being the top edge of pants, and said flaps being disposed above the fly portion.

4. The adjustable buckle of claim 1, said second member comprising a magnet, and said cover comprising a ferrous metal.

5. The adjustable buckle of claim 4, the width of said magnet being about 2–3 cms. so that said two positions are about 2–3 cms. apart.

6. An adjustable buckle comprising a first member comprising means to attach said member to a first material flap, and having engagement means oppositely disposed from said attachment means, and a second member comprising means to attach said second member to a second material flap and having engagement means oppositely disposed from said second attachment means, and a cover being formed with means to engage the first member engagement means and means to engage the second member engagement means in two positions so that the buckle secures the flaps in an overlying manner in the two positions, said cover comprising a flexible member, said flexible member being formed with a plurality of recesses, each recess being sized to receive said second engagement means in a plurality of positions, so that said buckle is adjustable to a plurality of positions.

7. The adjustable buckle of claim 6, said flexible member comprising a plastic, and said plastic member forming an insert in said cover.

8. The adjustable buckle of claim 7, said cover comprising a metal overcover for said plastic insert.

9. The adjustable buckle of claim 6, said engagement means and said flexible member being formed so that said engagement means slidably engages said member until sliding into said recess to the desired position, and when slidably engaged the cover can be lifted free of second member, and when recess engaged, the cover cannot be lifted free of said second member.

10. The adjustable buckle of claim 1, said attachment means being formed with tapered edges for passing through said material to the underside of said material.

11. The adjustable buckle of claim 2, the top side of said cover being curved so as to contour the garment when worn.

12. An adjustable buckle comprising a first fastener element having means to attach said first element to a first flap of a garment and a second fastener element having means to attach said second element to a second flap of the garment, said flaps being for closing the garment, an insert member being formed with a first plurality of recesses being sized to receive the first fastener element and a second recess sized to receive the second fastener element, whereby with the second element in the second recess the first element can be adjusted to move from one first recess to another to adjustably close the flaps and tighten the garment on the wearer.

13. The adjustable buckle of claim 12, said member being flexible so that said elements snap into the recesses of the flexible member.

14. The adjustable buckle of claim 13, further comprising a cover, said cover being formed so as to removably receive said insert member.

15. The adjustable buckle of claim 14, said cover being contoured to contour the curvature of the garment.

16. The adjustable buckle of claim 15, said insert member being H-shaped, with the legs of the H being flexible so as to receive the elements.

17. The adjustable buckle of claim 13, each said element being formed with a tapered prong, and said recesses being tapered to receive said prongs.

18. The adjustable buckle of claim 17, the adjustable buckle of claim 15, said insert member being H shaped, with the legs of the H being flexible so as to receive the elements.

19. The adjustable buckle of claim 17, where two opposed legs of said H are formed with said first plurality of recesses, and there are two opposed prongs to snap into said recesses.

20. The adjustable buckle of claim 18, the ends of said opposed legs being bevelled so as to contactingly engage said tapered prongs before entering the first opposed recesses immediately adjacent said bevelled edges.

* * * * *